US006675593B1

(12) United States Patent
Suydam et al.

(10) Patent No.: US 6,675,593 B1
(45) Date of Patent: Jan. 13, 2004

(54) WATER DISTRIBUTION APPARATUS

(76) Inventors: Michael Suydam, 317 State Rte. 33, Manalapan, NJ (US) 07726; Garth Conover, 33 Stillhouse Rd., Englishtown, NJ (US) 07726-8145

( * ) Notice: Subject to any disclaimer, the term of this patent is extended or adjusted under 35 U.S.C. 154(b) by 0 days.

(21) Appl. No.: 10/272,120

(22) Filed: Oct. 15, 2002

(51) Int. Cl.[7] ..... F25D 17/02; B67D 5/62
(52) U.S. Cl. ..... 62/188; 62/391
(58) Field of Search ..... 62/189, 389, 390, 62/391, 188; 222/146.1, 146.6

(56) References Cited

U.S. PATENT DOCUMENTS

| | | | | | |
|---|---|---|---|---|---|
| 3,118,289 | A | | 1/1964 | Schultz | 62/339 |
| 4,153,181 | A | * | 5/1979 | Parker et al. | 222/61 |
| 4,830,223 | A | * | 5/1989 | Priest | 222/146.6 |
| 4,957,624 | A | | 9/1990 | Peranio | 210/129 |
| 5,083,442 | A | | 1/1992 | Vlock | 62/338 |
| 5,349,992 | A | * | 9/1994 | Gallo et al. | 141/18 |
| 5,502,978 | A | * | 4/1996 | Field | 62/157 |
| 6,318,108 | B1 | * | 11/2001 | Holstein et al. | 62/279 |
| 6,508,070 | B1 | * | 1/2003 | Palmer | 62/201 |

FOREIGN PATENT DOCUMENTS

EP 0903496 A2 * 3/1999

* cited by examiner

*Primary Examiner*—Marc Norman
(74) *Attorney, Agent, or Firm*—Peter S. Canelias

(57) ABSTRACT

The invention relates an apparatus to extract clean, cooled or heated bottled water from a water cooler/dispenser for distribution to a refrigerator or ice maker or other remote outlet. More specifically, the invention relates to an originally installed, or retrofitted using a self-piercing saddle valve, remote dispensing apparatus for use with conventional water heating/cooling dispensers employing bottled water for dispensing the water substantially instantaneously to a remote outlet.

19 Claims, 6 Drawing Sheets

| PART# | QUANTITY | DESCRIPTION | SIZE | MANUFACTURER | PART # |
|---|---|---|---|---|---|
| 1. | 1 | DIAPHRAGM PUMP 115 VAC | 40PSI 1.0GPM | SHURflo | 8000-231-294 |
| 2. | 2 | MALE CONNECTOR, 1/4 TUBE x 3/8 MIPT | | JOHN GUEST FITTINGS | JG0302MC |
| 3. | AS REQUIRED | POLYETHYLENE TUBING 150PSI @ 70F 1/4" | | RADIATOR SPECIALTY CO. | DP308 |
| 4. | AS REQUIRED | "MANIFOLD" UNION TEE | 1/4" | SMC CORP. | KQT07-00 |
| 5. | AS REQUIRED (1) | TOGGLE SWITCH SPST | 15AMP. | CARLINGSWITCH | 15ASPST |
| 6. | 2 | PUMP BRACKET, | SEE PUR-ICE DRW..#1 | PUR-ICE | 6A & 6B |
| 7. | AS REQUIRED | CONNECTORS, INSULATED, BUTT SPLICE | 12-10 AWG | THOMAS & BETTS | 2RC10 |
| 8. | 4 | 10-24 x 1 1/4 S.S. COMBINATION HEAD SCREW | | ROCKFORD OR EQUIVALENT | |
| 9 | 8 | NYLON INSERT, LOCK NUT, S.S | # 10-24 | ROCKFORD OR EQUIVALENT | |
| 10. | 16 | WASHER, FLAT, S.S. | #10 | ROCKFORD OR EQUIVALENT | |
| 11. | 4 | COMBINATION HEAD SCREW, S.S. | 10-24 x 3/4 | ROCKFORD OR EQUIVALENT | |
| 11. | AS REQUIRED | # 12 STRANDED WIRE | 300v (BLACK) | DEARBORN WIRE/CABLE | 891265-1 |
| 12. | 2 AS REQUIRED W/#5 | NYLON INSULATED CONNECTOR, 12-10AWG | | THOMAS & BETTS | RC10-8FL |
| 13. | AS REQUIRED | # 12 STRANDED WIRE | 300v (RED) | DEARBORN WIRE/CABLE | 891265-3 |
| 14. | AS REQUIRED | # 12 STRANDED WIRE | 300v (YELLOW) | DEARBORN WIRE/CABLE | 891265-5 |
| 15. | AS REQUIRED | # 12 STRANDED WIRE | 300v (GREEN) | DEARBORN WIRE/CABLE | 891265-6 |
| 17. | AS REQUIRED | # 12 STRANDED WIRE | 300v (WHITE) | DEARBORN WIRE/CABLE | 891265-10 |
| 18. | 1 | SADDLE VALVE, SELF PIERCING | 1/4" | SupCo STV2-D OR PARKER EQUIV. | |
| 19. | AS REQUIRED | GOOSENECK COUNTER FIXTURE, SINGLE LEVER | | PasCo | 2040, 2040-TS & 2040-LR |
| 20. | AS REQUIRED | WIRE TIES, NYLON, | 4" | THOMAS & BETTS | L-4-18-9M |
| 21. | 1 | RING TERMINAL, NON-INSULATED #12AWG | | THOMAS & BETTS | NW10-10 |
| 22. | AS REQUIRED | LINE TAP, SCOTCHLOK, YELLOW 12-10 AWG | | 3M | 562 |
| 23 | AS REQUIRED | SCREW, WOOD | #8 x 1.0 INCH | | |

FIG. 6

WATER DISTRIBUTION APPARATUS

BACKGROUND OF THE INVENTION

The invention relates an apparatus to extract clean, cooled or heated bottled water from a water cooler/dispenser for distribution to a refrigerator or ice maker or other remote outlet. More specifically, the invention relates to a originally installed or retrofitted remote dispensing apparatus for use with conventional water heating/cooling dispensers having bottled water for dispensing the water substantially instantaneously to a remote outlet.

In general, clean cold water can be made available in a household by means of either an expensive refrigerator with a cold water dispenser or a separate cooler and replaceable water bottles. The prior art shows water cooling and distribution systems of various types. Currently, there are two methods of direct dispensing of clean, cold water in a home. One method involves the use of bottled water and a cooler, the cooler often rented to the consumer. The bottles must be replaced and/or refilled from time to time with new bottles containing the water supply. A second method involves the use of built-in water dispensers in modem refrigerators. Refrigerators incorporating cold water dispensers are relatively expensive, and for the owner of the more conventional refrigerator, the problem still exists. It would be extremely expensive to retrofit existing refrigerators to incorporate water coolers therein.

Another problem encountered with household water supplies is that of clean drinking water. Although the use of carbon and other filters has proliferated, carbon filters have a serious drawback. At room and higher temperatures, the charcoal used in such filters is a good breeding ground for bacteria. And, such filter systems do not allow the use of a conventional water cooler/heater to supply treated water to a remote location. In this situation, the consumer has already invested in a water cooler and replacement bottles in order to insure a steady supply of cooled or heated clean drinking water. Duplication in the form of additional water dispensers, bottles or cleaners is wasteful where the fresh treated water supply already exists within the home or office.

U.S. Pat. No. 3,118,289, which issued to R. Schultz on Jan. 21, 1964 and U.S. Pat. No. 5,083,442, which issued to M. Vlock on Jan. 28, 1992 provide solutions to one or the other of the problems mentioned above. However, the Schultz patent does not address the problem of clean water, and the Vlock refrigerator would be expensive to produce. In order to obtain cold water using the Schultz apparatus, it would be necessary to flush all of the warm water out of any pipes or tubes downstream of the water tank in the refrigerator. Adapting the Vlock cooling system to existing conventional refrigerators would be too expensive to be practical. U.S. Pat. No. 5,502,978, issued to Field on Apr. 2, 1996, shows a carbon filter recirculating system. This invention involves a carbon filter and cooling reservoir combination for mounting in a refrigerator, a pipe system containing a faucet for dispensing cold water and returning water to the filter, and a pump/timer combination for periodically recycling the water in the pipe system through the filter, whereby cold water is always available at the faucet.

Another attempt to solve the problem of remote availability of a water supply is found in kits available from manufacturers of liquid pumps, which ordinarily comprise a pump with tubing to siphon water from a bottle and supply the siphoned water to a remote location. This system has the drawback of requiring duplication of resources and extra storage space for a large water container. Another drawback of this system is that the water is not conditioned by the water cooler unit prior to its being transmitted to a remote location. Thus water can be neither cooled nor heated by a water cooler unit, and duplicate heating or cooling means must be supplied intermediate the water container and the remote outlet.

Again, none of these inventions solve the problem of making a pre-existing water supply in a conventional water cooler/heater available to remote locations. The present invention provides a simple, inexpensive means of providing the water from a pre-existing water cooler to remote locations on demand without duplication of the water cooler equipment and without extensive modification of existing refrigerators or plumbing.

SUMMARY OF THE INVENTION

The present invention provides a simple, inexpensive means of pumping bottled water from a pre-existing water cooler to remote locations such as refrigerators and water faucets on demand without duplication of the water cooler equipment and without extensive modification of existing refrigerators or plumbing. The invention employs conventional, easily available parts with a custom pump bracket assembly in order to achieve its result. The invention also allows bottled water suppliers to retrofit bottled water dispensers/coolers in order to supply clean drinking water to refrigerators, sinks, and other remote outlet or faucet locations.

The invention can supply a conventional refrigerator icemaker whether the icemaker is a stand-alone interior unit or a door mounted dispenser. The pumping of the water from the remote water dispenser is automatic and on demand, employing a pump that is sensitive to a pressure drop caused by opening a remote faucet.

In accordance with the present invention, there is provided an apparatus whereby conventional bottled water dispensers/coolers may be used to supply water to a remote outlet;

Another object of this invention is to provide an apparatus for pumping a consumer's favorite bottled water brand automatically into the ice maker and water dispenser of a conventional refrigerator;

Another object of this invention is to provide an apparatus for pumping a bottled water such that the consumer can locate the bottled water dispenser/cooler anywhere in a home or office;

Another object of this invention is to provide an apparatus for pumping a bottled water automatically on demand when a remote faucet is opened;

Another object of this invention is to provide an apparatus that may be retrofitted to existing bottled water dispensers;

Another object of this invention is to provide an apparatus that may be installed in existing homes and office or in new construction;

Other objects and advantages will be more fully apparent from the following disclosure and appended claims.

Accordingly, the present invention relates to a an apparatus for use with a bottled water dispenser comprising, depending on the application, a self-puncturing type pipe tap/saddle mount; a pump with a built-in predetermined constant pressure sensing device that keeps the pressure at a factory set level, and tubing sufficient to connect the water dispenser with the remote outlet

BRIEF DESCRIPTION OF THE DRAWINGS

The above-mentioned and other features and objects of this invention and the manner of obtaining them will become apparent and the invention itself will be best understood by reference to the following description of an embodiment of the invention taken in conjunction with the accompanying drawings, wherein:

FIG. 6 is a parts list for preferred embodiments of the invention.

DETAILED DESCRIPTION

Figure 5:
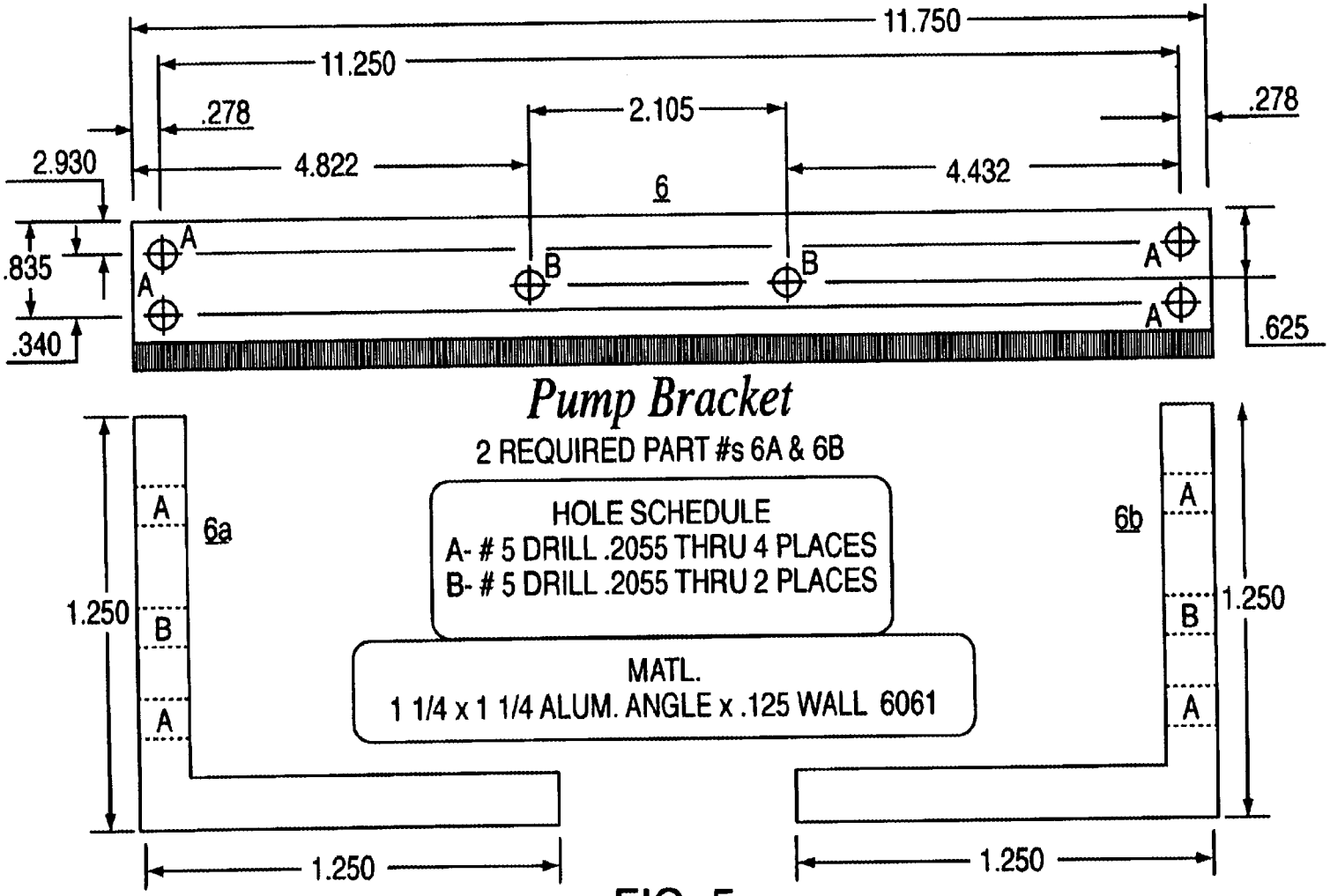
FIG. 5 is a view of the pump bracket.

This invention is comprised of items manufactured by others, except for the pump bracket 6, listed in FIG. 6 and shown in FIG. 5. The invention is designed to give bottled water suppliers the ability to retrofit bottled water dispensers/coolers that are in place at this time. The invention may also be used in new production units with the omission of one part, the self-piercing saddle valve 18 listed in FIG. 6, substituting an alternative valve for diversion of the water from the unit.

Figure 1:
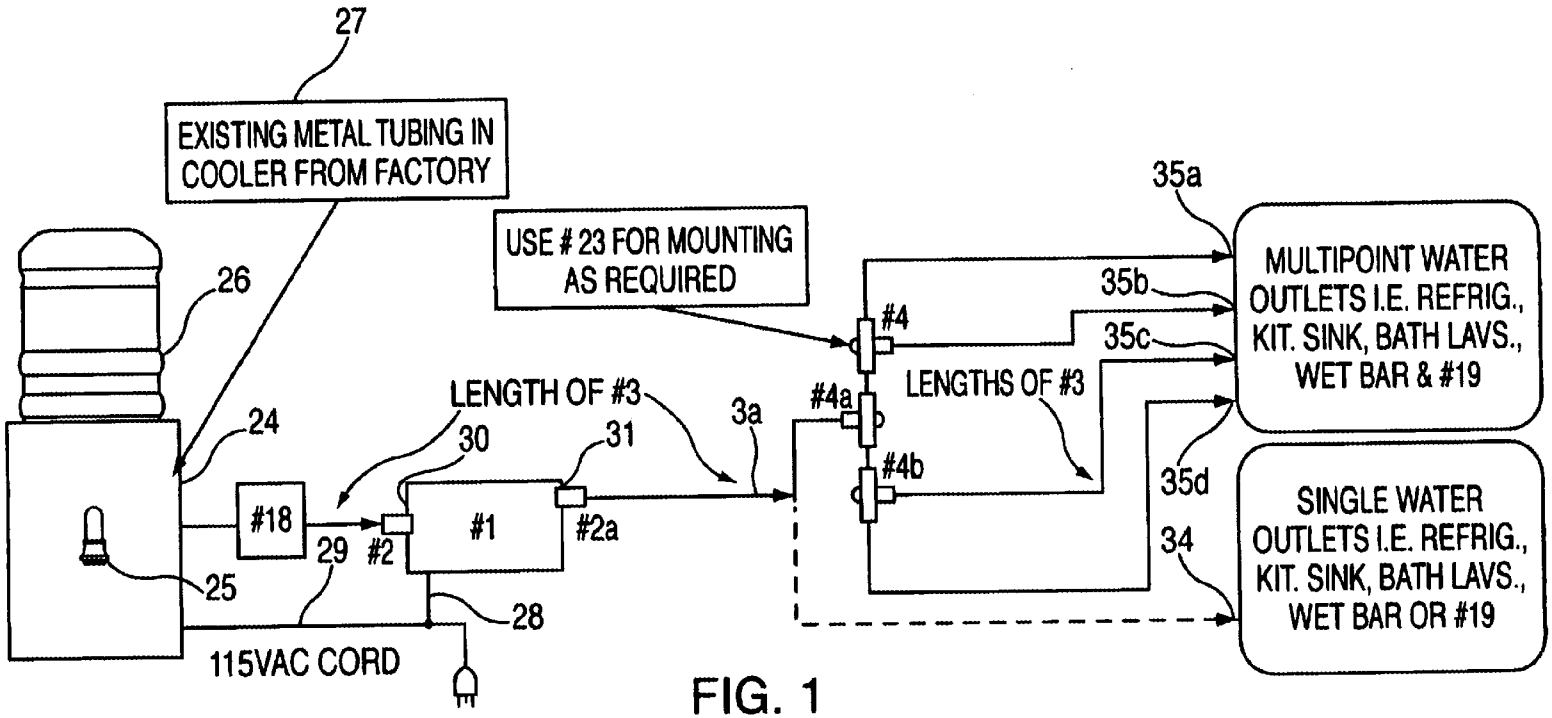
FIG. 1 is a schematic view of an embodiment of the invention used with a single faucet water dispenser.

Referring now to the drawings, FIG. 1 illustrates a preferred embodiment of the invention where the existing water dispenser 24 has a single faucet 25. The dispenser 24 also carries a water bottle 26 in the conventional manner. The dispenser 24 has internal existing tubing forming a conduit 27 (usually metal) installed during manufacture of the dispenser 24. The conduit 27 is fluidly connects the water bottle 26 with the faucet 25. Prior to the termination of conduit 27 at faucet 25, a self-piercing saddle valve 18 is attached to the conduit 27 so that the conduit 27 is pierced and sealed to form a valve by which water may be extracted from the conduit 27 and diverted to a remote location. The self-piercing saddle valve 18 is fluidly connected to a polyethylene tube 3 of sufficient length to enable the respective desired locations of the water dispenser 24 and the remote outlet.

The polyethylene tubing 3 is fluidly connected by means of a male connector 2 to an inlet port 30 of diaphragm pump 1. The diaphragm pump 1 is preferably an automatic, pressure sensitive pump such as that manufactured by SHURflo, listed in FIG. 6. The power to the diaphragm pump 1 is supplied by a conventional AC power cord 28, preferably at standard U.S. household voltage of 115 volts. The power cord 28 is preferably spliced or wired into the power supply cord 29 that supplies power to the water dispenser 24, thus eliminating the need for two power outlets.

The diaphragm pump 1 has a second male connector 2*a* located at an outlet port 31 for fluidly connecting the diaphragm pump 1 with polyethylene tube 3*a* at the outlet side of diaphragm pump 1. At this point, for single water outlets 34 such as a refrigerator, kitchen sink, bathroom lavatory, wet bar, or an optional gooseneck counter fixture 19 as listed in FIG. 6, the tube 3*a* is of sufficient length to connect to the single remote location. The gooseneck counter fixture 19 may be installed in the kitchen sink or into any area of the countertop as required by the consumer. This gooseneck fixture 19 may also be installed in any lavatory or other area such as a wet bar or recreation area in the home whether it is an existing home or incorporated in the construction of a new home.

Where multiple water outlets or plumbing points (35*a, b, c, d*) are to be configured with the same water supply, the tube 3*a* is fluidly connected to a manifold comprised of one or more union tees 4, 4*a* and 4*b*, preferably female tees manufactured by SMC as listed in FIG. 6. The union tees 4, 4*a* and 4*b* are preferably mounted to a floor joist or base trim using one or more wood screws 23 of the size listed in FIG. 6, and are shown in FIG. 1 connected in series with lengths of polyethylene tubing. Three of these manifold union tees 4, 4*a* and 4*b* provide water from the water bottle 26 to four (4) remote outlets in the configuration shown in FIG. 1. In general, one tee 4 can supply two (2) remote outlets; two (2) tees will supply three (3) outlets, etc.

Figure 2:
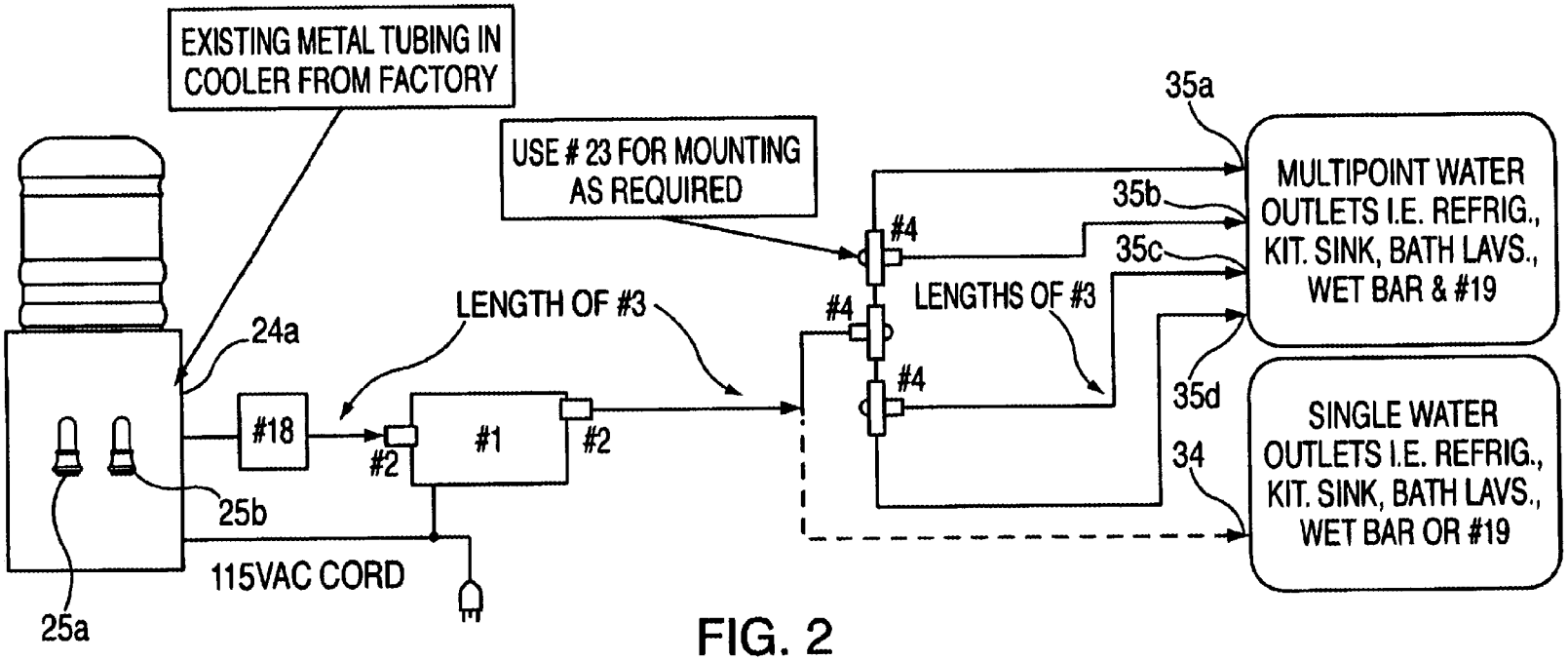
FIG. 2 is a schematic view of an embodiment of the invention used with a dual faucet water dispenser.
Figure 3:
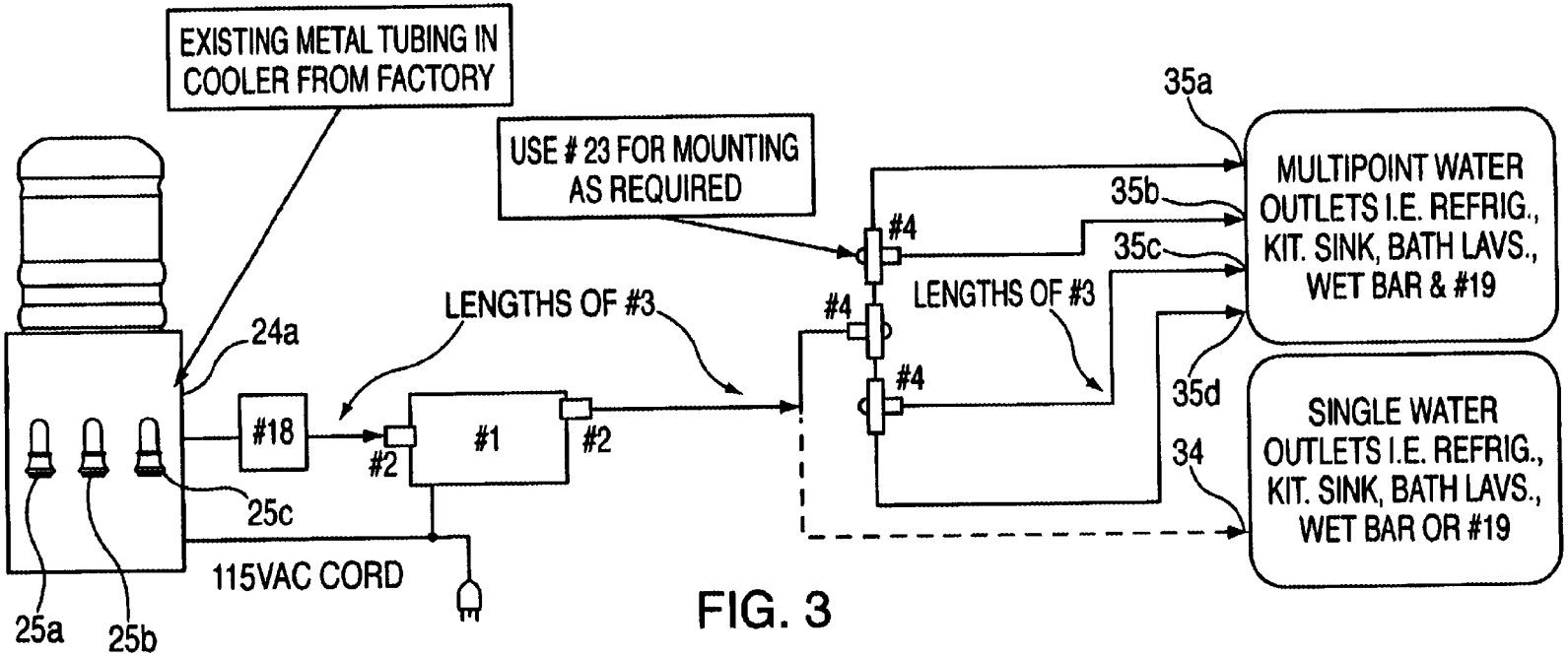
FIG. 3 is a schematic view of an embodiment of the invention used with a three faucet water dispenser.

FIG. 2 shows the embodiment of the invention applied to a water dispenser 24*a* configured with two spigots or outlets 25*a* and 25*b*. FIG. 3 shows the embodiment of the invention applied to a water dispenser 24*b* configured with three spigots or outlets 25*a*, 25*b* and 25*c*. It is customary for one of the three spigots to supply cooled water, one to supply heated water, and one to supply room temperature water. Depending on the desired outlet, the consumer may tap into any of the three supply lines for the desired water temperature to be supplied at the remote outlet (34 or 35*a, b, c, d*).

Figure 4:
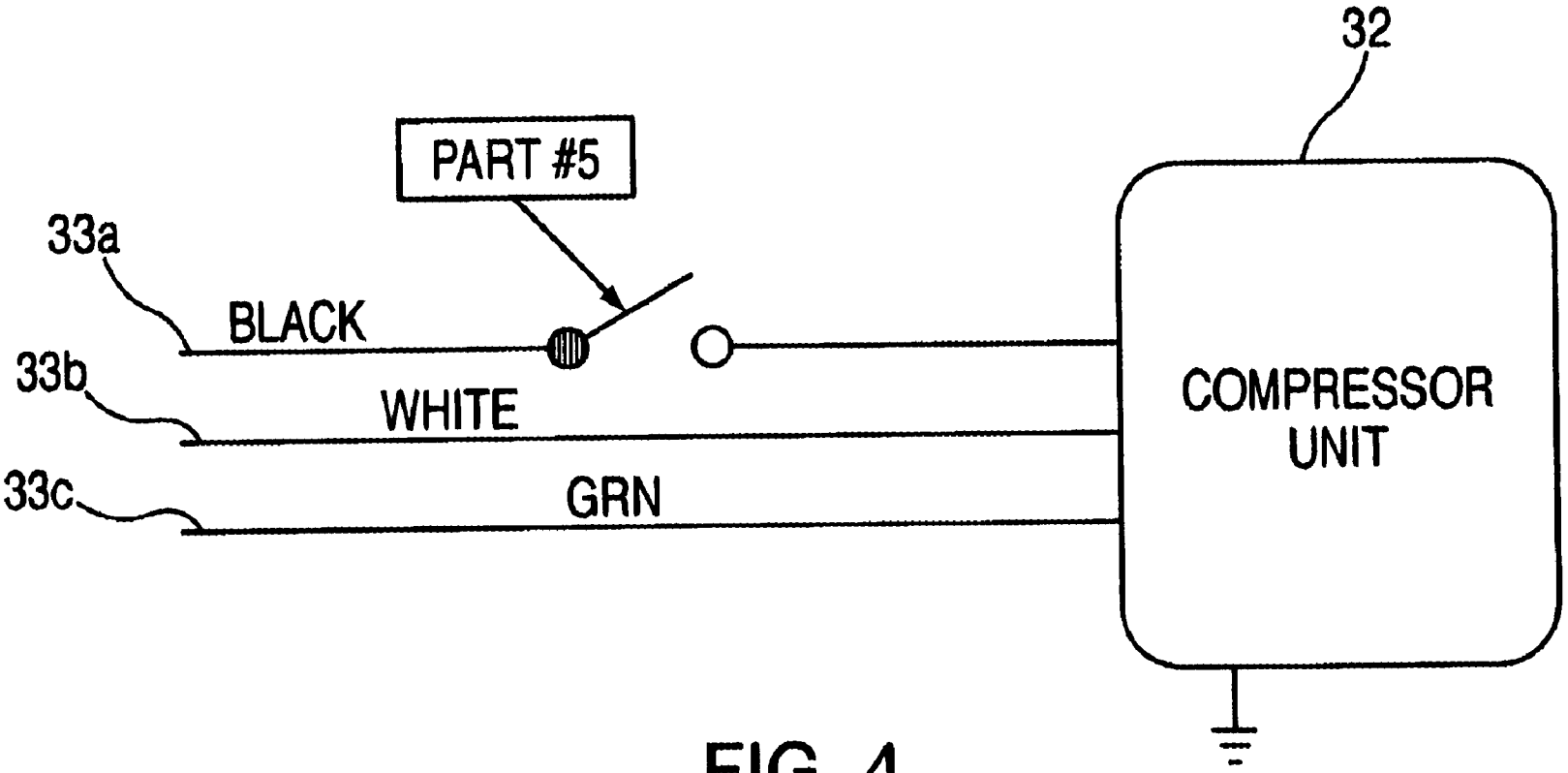
FIG. 4 is a schematic showing the inclusion of a switch.

In the case of the water cooler 24 only being used to supply a refrigerator model that has either an interior only or door mounted water and ice dispenser, the consumer may not want or need to get cold water directly from the cooler itself. FIG. 4 shows the use of a toggle switch 5 (usually installed by the water company mechanic) shown in the off position. Some coolers already have an option to turn off the cooler's compressor (some units having a hot water outlet may also have an independent switch installed in the heater power line). But in the case of a particular cooler not having this option, the 15 amp. (ampere) toggle switch 5 and two nylon insulated connectors 12 would be used. The toggle switch 5 should be installed in series in the compressor 32 AC hot lead 33*a* (black), as opposed to the white lead 33*b* or the green 33*c*. This would allow the installer to switch off the compressor unit 32 while still maintaining AC input to the pump 1. The wiring would be completed using #12 stranded wire in black (FIG. 6, part 11), red (FIG. 6, part 13), yellow (FIG. 6, part 14), green (FIG. 6, part 15) and white (FIG. 6, part 17) as required. This optional switch being installed would not only save wear and tear on the compressor unit in the cooler, it would also allow the consumer's utility bill to remain at the current level. The inclusion of this switch 5 would also be reflected in lower parts and replacement costs in overall maintenance of the cooler.

FIG. 5 shows a pump bracket 6, comprised of two identical bracket parts 6*a* and 6*b*. Each bracket part is an aluminum "L" shaped bracket with each side preferably one and one quarter inches in length. The configuration shown in FIG. 5 designates a hole schedule for drilling four "A" holes and two "B" holes as shown. With the center to center distance between "B" holes being 2.105 inches. The pump bracket 6 allows the diaphragm pump 1 to be secured to a surface convenient for the use and/or maintenance of the diaphragm pump 1.

In operation, the water bottle 26 supplies water through the conduit 27 located in dispenser 24, where the water supply is diverted though the saddle valve 18 into a polyethylene tube 3 to supply a pump 1 that has a constant pressure sensing device built into the pump 1 that keeps the pressure at a predetermined level, usually a factory set level. When the consumer demands water from the refrigerator, in the case of a door mounted water dispenser the pump 1 turns on automatically when it senses the pressure drop. In turn pump 1 stops when demand ends and line pressure is back up to the preset factory level. In respect to the unit supplying the icemaker it works in the same fashion. The only difference is that the solenoid valve on the refrigerator is opened by a command from the icemaker as opposed to the customer. When the ice tray assembly in the icemaker in full, the icemaker closes the supply solenoid and the pump 1 again stops at the preset pressure.

Since other modifications or changes will be apparent to those skilled in the art, there have been described above the principles of this invention in connection with specific apparatus, it is to be clearly understood that this description is made only by way of example and not as a limitation to the scope of the invention.

What is claimed is:

1. An apparatus for dispensing water from a water dispenser unit to a remote location, said apparatus comprising:

a water dispenser unit having a water reservoir, an outlet, and a conduit fluidly coupling said water reservoir with said outlet;

a valve for tapping said conduit and allowing water from said water reservoir to exit said conduit before said outlet;

a diaphragm pump for pumping water from said conduit though said valve;

a first tube fluidly coupling said diaphragm pump pumping means with said conduit though said valve;

a second tube fluidly coupling said diaphragm pump with a dispensing means, said diaphragm pump coupled to and pumping water through said first tube and said second tube, said diaphragm pump further comprising a pressure sensor for operating said diaphragm pump upon detection of a drop in pressure within said second tube:

said diaphragm pump drawing water from said water reservoir though said conduit, into said second tube and outputting to said dispensing means.

2. The apparatus of claim 1, wherein said valve is a self-tapping valve for tapping into said conduit.

3. The apparatus of claim 1, wherein said water dispenser unit further comprises a compressor;

said compressor having a switch for activating and deactivating a power supply to said compressor.

4. The apparatus of claim 1, further comprising a pump bracket for securely holding said diaphragm pump.

5. The apparatus of claim 4, wherein said pump bracket is comprised of a first bracket part and a second bracket part, said first bracket part and said second bracket part being L-shaped.

6. An apparatus for dispensing water from a water dispenser unit to a remote location, said apparatus comprising:

a water dispenser unit having a water reservoir, an outlet, and a conduit fluidly coupling said water reservoir with said outlet;

a valve for tapping said conduit and allowing water from said water reservoir to exit said conduit before said outlet;

a diaphragm pump for pumping water from said conduit though said valve;

a first tube fluidly coupling said diaphragm pump with said conduit though said valve;

a second tube fluidly coupling said diaphragm pump with a manifold;

said diaphragm pump coupled to and pumping water through said first tube and said second tube, said diaphragm pump further comprising a pressure sensor for operating said diaphragm pump upon detection of a drop in pressure within said second tube;

said diaphragm pump drawing water from said water reservoir though said conduit, into said second tube and outputting to said manifold.

7. The apparatus of claim 6, wherein said valve is a self-tapping valve for tapping into said conduit.

8. The apparatus of claim 6, wherein said water dispenser unit further comprises a compressor;

said compressor having a switch for activating and deactivating a power supply to said compressor.

9. The apparatus of claim 6, further comprising a pump bracket for securely holding said diaphragm pump.

10. The apparatus of claim 9, wherein said pump bracket is comprised of a first bracket part and a second bracket part, said first bracket part and said second bracket part being L-shaped.

11. The apparatus of claim 6, wherein said manifold further comprises a union tee for directing water to a plurality of outlets.

12. The apparatus of claim 6, wherein said manifold further comprises a plurality of union tees for directing water to a plurality of outlets.

13. An apparatus for dispensing water from a water dispenser unit to a remote location, said apparatus comprising:

a water heater unit having a water reservoir, a heater for heating water from said water reservoir, an outlet, and a conduit fluidly coupling said water reservoir with said outlet;

a valve for tapping said conduit and allowing heated water to exit said conduit before said outlet;

a diaphragm pump for pumping heated water from said conduit though said valve;

a first tube fluidly coupling said diaphragm pump with said conduit though said valve;

a second tube fluidly coupling said diaphragm pump with a dispensing means;

said diaphragm pump coupled to and pumping water through said first tube and said second tube, said diaphragm pump further comprising a pressure sensor for operating said diaphragm pump upon detection of a drop in pressure within said second tube;

said diaphragm pump drawing water from said water reservoir though said heater, through said conduit, into said second tube and outputting to said dispensing means.

14. The apparatus of claim 13, wherein said valve is a self-tapping valve for tapping into said conduit.

15. The apparatus of claim 13, wherein said water dispenser unit further comprises a compressor, said compressor having a switch for activating and deactivating a power supply to said compressor.

16. The apparatus of claim 13, further comprising a pump bracket for securely holding said diaphragm pump.

17. The apparatus of claim 16, wherein said pump bracket is comprised of a first bracket part and a second bracket part, said first bracket part and said second bracket part being L-shaped.

18. The apparatus of claim 13, further comprising a manifold located before said dispensing means, said manifold having a union tee for directing water to a plurality of outlets.

19. The apparatus of claim 18, wherein said manifold further comprises a plurality of union tees for directing water to a plurality of outlets.

* * * * *